United States Patent [19]

Bond et al.

[11] 4,396,786

[45] Aug. 2, 1983

[54] METHOD FOR PRODUCING FUEL OIL FROM CELLULOSIC MATERIALS

[75] Inventors: Geoffrey C. Bond, Sarratt; Alfred J. Bird, Hounslow, both of England

[73] Assignee: Johnson Matthey Public Limited Company, London, England

[21] Appl. No.: 270,814

[22] Filed: Jun. 5, 1981

Related U.S. Application Data

[63] Continuation-in-part of Ser. No. 201,153, Oct. 27, 1980, abandoned, which is a continuation of Ser. No. 46,337, Jun. 7, 1979, abandoned, which is a continuation of Ser. No. 877,124, Feb. 13, 1978, abandoned, which is a continuation of Ser. No. 470,300, May 15, 1974, abandoned, which is a continuation of Ser. No. 232,773, Mar. 8, 1972, abandoned.

[51] Int. Cl.[3] ..... C07C 1/00

[52] U.S. Cl. ..... 585/240; 44/50; 44/2.5; 44/10

[58] Field of Search ..... 44/50; 201/2.5, 25, 201/30, 36, 37, 38, 153; 208/9, 10; 210/774, 775; 585/240

[56] References Cited

U.S. PATENT DOCUMENTS

| | | | |
|---|---|---|---|
| 2,115,336 | 4/1938 | Krauch et al. | 208/10 |
| 3,694,694 | 9/1972 | Sprow et al. | 208/10 |
| 4,266,083 | 5/1981 | Huang | 585/240 |
| 4,273,643 | 6/1981 | Bennett | 208/10 |

FOREIGN PATENT DOCUMENTS

| | | | |
|---|---|---|---|
| 194239 | 3/1957 | Austria . | |
| 70259 | 9/1930 | Sweden | 585/240 |

*Primary Examiner*—Charles F. Warren
*Assistant Examiner*—Y. Harris-Smith
*Attorney, Agent, or Firm*—Cushman, Darby & Cushman

[57] ABSTRACT

A method for producing fuel oil from cellulosic materials (especially domestic or agricultural waste) in which the material is contacted with water and treated with a reducing gas (eg hydrogen or methane) and carbon monoxide in the presence of a platinum group metal (preferably ruthenium) or copper catalyst at 100° to 950° C. (preferably 100° to 250° C.) and at 10 to 680 (preferably 10 to 100) atmospheres. It is believed that the cellulose is hydrolyzed, then carbonylated to a keto acid which decarboxylates to produce a polymerizable acid and carbon dioxide. The aldehyde polymerizes and is hydrogenated to produce the fuel oil.

14 Claims, No Drawings

METHOD FOR PRODUCING FUEL OIL FROM CELLULOSIC MATERIALS

This invention is a continuation-in-part of our copending application Ser. No. 06/201,153 filed on Oct. 27, 1980 now abandoned which in turn was a continuation of our application Ser. No. 06/046,337 L (now abandoned) filed on June 7, 1979 which in turn was a continuation of our application Ser. No. 05/877,124 (now abondoned) filed on Feb. 13, 1978 which in turn was a continuation of our application Ser. No. 05/4780,300 (now abandoned) filed on May 15, 1974 which in turn was a continuation of our application Ser. No. 05/232,773 (now abandoned) which was filed on Mar. 8, 1972. The contents of application Ser. No. 06/201,153 are herein incorporated by reference.

BACKGROUND OF THE INVENTION

1. Field of the Invention

This invention relates to a method of producing fuel oil from cellulosic materials, especially from cellulosic garbage by a catalytic hydrogenation performed on a derivative of the garbage.

2. Description of the Prior Art

For over 50 years attempts have been made to find a commercially viable method for making fuel oil by catalytically hydrogenating coal or similar carbonaceous materials. Generally the coal is hydrogenated in the presence of cheap expendable catalysts such as metals (including metal compounds) of Group 8 of the first transition period namely iron, cobalt and nickel or of Group 6A namely chromium, molybdenum and tungsten or of the first period of mid-transition metals namely vanadium,, chromium and manganese or certain amphoteric metals, namely zinc and aluminium. In practice in order to achieve commercially acceptable yields, the conventional hydrogenations have been performed at temperatures above the critical temperature of water (i.e. 374° C.) and at pressures above 100 atmospheres which is usually regarded as the maximum pressure safely containable within a welded vessel. For example, U.S. Pat. No. 2,115,336 (issued in 1938) teaches the hydrogenation of Jura shale oil using a catalyst comprising molybdenum and aluminium compounds at temperatures of from 450° to 500° C. and pressures of above 200 atmospheres. Carbon monoxide rapidly poisons the cheap expendable catalysts listed above and so the gas could not be tolerated in the hydrogen used in the conventional hydrogenation of coal. However, U.S. Pat. No. 3,694,342 teaches that the hydrogenation of coal using hydrogen containing some carbon monoxide can be performed using for example catalysts comprising a metal of Group 8 of the first transition period, i.e. iron, cobalt and nickel provided the hydrogenation is performed in a hydrogen donor solvent and provided steam is introduced into the reaction zone "to offset the deactivation tendencies of carbon monoxide." The carbon monoxide is "offset" by the occurrence of the water gas shift reaction, i.e.

$$CO+H_2O \rightarrow CO_2+H_2$$

In short the essence of the teaching of U.S. Pat. No. 3,694,342 is to remove poisonous carbon monoxide from the reaction by converting it to harmless carbon dioxide.

SUMMARY OF THE INVENTION

An object of this invention is to provide a method for producing fuel oil by catalytic hydrogenation of cellulosic material using a reducing gas which contains carbon monoxide and using conditions which promote removal of carbon dioxide from the reducing gas. The method has been discovered to be particularly suitable for use with predominantly cellulosic material whereas conventional processes have used predominantly carbonaceous raw materials such as coal. It is possible that the suitability of the method for use on cellulosic materials arises from the presence of the carbon monoxide which leads to the production of a water soluble keto acid intermediate compound. The intermediate decomposes to a polymerisable aldehyde intermediate with the liberation of carbon dioxide. Then in turn the aldehyde polymerises and under hydrogenation conditions the polymerised aldehyde gives rise to the fuel oil. It is believed to be important in promoting the production of the fuel oil to keep the partial pressure of the carbon monoxide high and to keep the partial pressure of the carbon dioxide low.

Another object of the invention is to provide a method which uses liquid water as a solvent instead of the more expensive hydrogen donor solvents. An object of a refinement of the invention is to provide a method which leaves the hydrogenation catalyst in a easily recoverable form. A further object of the invention is to provide a convenient method for disposing of large quantities of cellulosic waste.

Accordingly this invention provides a method for producing fuel oil from cellulosic material which comprises contacting the cellulosic material with liquid water and treating contacted material with a reducing gas and carbon monoxide in the presence of a catalyst comprising at least one metal, alloy of a metal and/or compound of a metal wherein the metal is selected from the group consisting of ruthenium, rhodium, palladium, osmium, iridium, platinum and copper and at an initial temperature of from 100° to 950° C. and an initial pressure of from 10 to 680 atmospheres. During performance of the method the pressure usually increases from the initial pressure and the temperature may fluctuate. Preferably the liquid water is alkaline.

The catalyst may be used in the form of an aqueous solution or a finely divided suspension or it may be precipitated in finely divided form onto a substrate which may be for example the cellulosic material itself. Preferably the catalyst is finely divided ruthenium or finely divided ruthenium dioxide. A preferred catalyst may be prepared by subjecting an alkaline solution of sodium ruthenate comprising about 1% by weight of ruthenium to the initial reaction conditions used in the method whereupon ruthenium dioxide appears to precipitate from solution predominantly onto the cellulosic material present so giving an intimate contact between the catalyst and the cellulosic material. After completion of the method, the catalyst (especially if it comprises ruthenium) normally remains associated with the unconverted residue and so is easily recoverable. The ability to recover the catalyst considerably reduces the cost of performing the method.

The reducing gas may be hydrogen, a hydrocarbon which is gaseous at normal temperatures and pressures, for example methane or natural gas, a synthetic gas such as water gas, producer gas or synthesis gas or a mixture of two or more of these reducing gases. Under the conditions encountered in the performance of the method, a mixture of carbon monoxide and steam may be used to provide a reducing gas as follows:

$$CO+H_2O \rightarrow CO_2+H_2$$

It is an advantage of the invention that not only can the presence of carbon monoxide be tolerated but it is actually required and so cheaper reducing gases can be used if required.

Preferably the temperatures employed in the performance of the method lie in the range 100° C. to 950° C. and the pressures lie in the range 10 to 680 atmospheres. A feature of the method of this invention is that it can be performed under quite mild conditions such as at temperatures up to 250° C. and final pressures in the range 25 to 100 atmospheres. Using hydrogen as the reducing gas, good results were obtained using initial pressures in the range 1 to 33 atmospheres.

Domestic, agricultural or industrial wastes provide a convenient source of the cellulosic raw material used in the performance of this invention. A major proportion of domestic garbage comprises paper, cardboard and other packaging materials which are largely cellulosic. Sewage sludge provides another source of cellulosic material. Agricultural waste products containing a large quantity of cellulose include sugar cane, sugar beet pulp, waste corn products, waste vegetable products, wood pulp, waste from food processing industries and animal manure. Accordingly the invention provides a convenient method for disposing of cellulosic wastes. The cellulosic raw material consists typically of 40% by weight of dry organic material and 60% by weight of water which is mostly in bound form. If necessary the cellulosic material may be shredded and it may be contained in fuel oil previously produced by the method of this invention.

The fuel oils obtained by this invention are organic oils which are in many ways of the conventional fuel oil type. For example they may be refined by techniques similar to those used in the refining of crude hydrocarbon oils.

It is believed that catalysts such as the platinum group metals (especially ruthenium) used in the performance of this invention also indirectly promote the decarboxylation of the keto acid by catalysing a reverse water gas shift reaction as follows:

$$CO_2+H_2 \rightarrow CO+H_2O$$

$$3CO_2+CH_4 \rightarrow 4CO+2H_2O$$

The removal of carbon dioxide by this reverse shift is believed to promote decarboxylation of further keto acid and also to supply carbon monoxide for the production of further keto acid from hydrolysed cellulosic material. In short it appears that the reverse water gas shift reaction is very important to the invention. High partial pressure of reducing gas (for example hydrogen or methane) ensures that the shift equilibrium is biassed to the right, that is to say is biassed to low partial pressures of carbon dioxide and to high partial pressures of carbon monoxide.

DESCRIPTION OF EXAMPLES 1 TO 8 AND OF COMPARATIVE EXAMPLES A TO D

The invention is illustrated by the following examples all of which were performed in Baskerville and Lindsey high pressure autoclaves using the following procedure.

50 g of a shredded newspaper were loaded into the autoclave together with 200 mls of water containing 2 g sodium bicarbonate and 0.05 g ruthenium in the form of dissolved sodium ruthenate. Various gases were charged to the autoclave at various initial pressures, the gases and initial pressures being as specified in Table 1. The autoclave was then sealed and heated to 250° C. over a period of 2 hours. It was held at this temperature for a further hour by when the pressure had risen to a final pressure as specified in Table 1. The autoclave was then allowed to cool to room temperature, then evacuated by vacuum and opened. The autoclave was found to contain an aqueous solution and a solid water-insoluble fraction comprising oil and a residue. The residue was filtered from the solution and the oil was extracted using a mixture of benzene and acetone. The yield of oil obtained after extraction is shown in Table 1 expressed as a percentage by weight of oil based on the weight of the cellulosic starting material. Table 1 also shows the weight of the residue obtained expressed as a percentage by weight based on the weight of the cellulosic starting material and the weight percentage conversions achieved.

Comparative example A shows that in the absence of ruthenium and relying on carbon monoxide generated in situ, very little oil is produced and very little of the cellulosic starting material is converted to anything. Comparative example B shows that when the only gas charged is nitrogen, the yield of oil is low although a high conversion of the starting material to some other products occurs. Comparative examples C and D show that by using a ruthenium catalyst, charging a reducing gas and relying on carbon monoxide generated in situ, the yields of oil are improved but are still low when the initial pressure is only 1 atmosphere.

Comparative example A and examples 1, 2 and 3 illustrate the consequences of increasing pressure when the charged gas is hydrogen and carbon monoxide is generated in situ. An increase in the initial pressure of from 1 to 20 atmospheres is accompanied by a substantial increase in oil yield. A further increase from 20 to 33 atmospheres is accompanied by a negligible improvement in yield and an increase in final pressure of from 50 to 100 atmospheres is accompanied by only a modest improvement in yield.

Examples 4, 5 and 6 show that particularly good results were obtained when carbon monoxide was charged to the autoclave along with the reducing gas instead of relying on generation of carbon monoxide in situ. A comparison of examples 4 and 5 shows that increasing the final pressure from 50 to 100 atmospheres reduces the oil yield and presumably indicates promotion of the unwanted methanation of carbon monoxide i.e.

$$CO+3H_2 \rightarrow CH_4+H_2O$$

This reaction reduces availability of carbon monoxide and hence inhibits production of the keto acid intermediate. Increasing the final pressure much beyond 50 atmospheres is of questionable benefit.

A comparison of examples 4 and 6 and 2 and 7 shows that adding inert gas to the autoclave while maintaining the total pressure constant produces a marginal variation in oil yield indicating that lowering the partial pressure of the active gases produces results comparable to those obtained in the absence of inert gas.

Finally if waste disposal is the primary objective, Example 8 is of importance because it shows that the best conversion of cellulosic starting material was obtained by charging carbon monoxide and relying on a reducing gas (namely hydrogen) generated in situ.

The amounts of ruthenium remaining associated with the residue after completion of examples 2 to 7 were determined and are shown in Table 2. The amounts remaining were sufficient for economic recovery.

TABLE 2

| Example | Weight of Residue g | % by weight Ru | Weight of Ru on residue g |
|---|---|---|---|
| 2 | 7.4 | 0.76 | 0.056 |
| 3 | 5.5 | 1.04 | 0.057 |
| 4 | 4.5 | 1.36 | 0.060 |
| 5 | 3.8 | 1.54 | 0.058 |
| 6 | 3.6 | 1.52 | 0.055 |
| 7 | 5.7 | 1.02 | 0.058 |

The intermediates, including the water soluble keto acid were isolated and examined as follows:

TABLE 1

| Example | Gas Charged | Initial Autoclave Pressure:atms | Final Autoclave Pressure:atms | Percentage Oil | Percentage Residue | Percentage Conversion | Weight of Intermediate g |
|---|---|---|---|---|---|---|---|
| A | *$H_2$ | 33 | 50 | 5 | >80 | <20 | 21.9 |
| B | $N_2$ | 1 | 25 | 3.3 | 28.2 | 71.8 | 27.9 |
| C | $H_2$ | 1 | 30 | 13.7 | 23.8 | 76.2 | 26.6 |
| D | $CH_4$ | 1 | 40 | 12.6 | 14.6 | 85.4 | 27.1 |
| 1 | $H_2$ | 20 | 50 | 24.1 | 10.9 | 89.1 | — |
| 2 | $H_2$ | 33 | 50 | 24.9 | 14.8 | 85.2 | 27.6 |
| 3 | $H_2$ | 33 | **100 | 29.8 | 11.0 | 89.0 | 24.3 |
| 4 | $H_2$/CO | 26 $H_2$ 7 CO | 50 | 38.6 | 9.0 | 91.0 | 25.8 |
| 5 | $H_2$/CO | 20 $H_2$ 10 CO | **100 | 33.6 | 7.6 | 92.4 | 27.2 |
| 6 | $H_2$/CO/$N_2$ | 3 $H_2$ 10 CO 20 $N_2$ | 50 | 35.4 | 7.2 | 92.8 | 23.6 |
| 7 | $H_2$/$N_2$ | 3 $H_2$ 30 $N_2$ | 50 | 30.1 | 11.4 | 88.6 | 26.1 |
| 8 | CO | 33 | 50 | 28.9 | 2.6 | 97.4 | 25.6 |

*No Ruthenium catalyst used.
**smaller autoclave used.

The water solution from the reactor was bulked up to 400 mls with washings from the filtration. A 50 mls aliquot was taken and evaporated to dryness in a tared beaker heated on a water bath. The weight of residue was taken to be the quantity of water soluble intermediate. No attempt was made to separate the contribution to this weight made by sodium salts.

Infra red spectra of the water soluble intermediate were made by evaporating acetone solutions onto a rock salt window. The spectra were obtained on a "Unicam" (Trademark) SP200 spectrophotometer. No deliberate attempt was made to obtain samples of uniform thickness although spectra of fairly uniform density were obtained.

The infra red spectra showed prominent bands at 3400 $cm^{-1}$ (hydroxyl), 2980 $cm^{-1}$ (aliphatic C—H stretch), 1580 $cm^{-1}$ and 1420 $cm^{-1}$ (symmetrical and antisymmetrical vibrations of $COO^-$). Acidification of the water soluble intermediate with hydrochloric acid gave a mixture of sodium chloride and an alcohol soluble organic compound having an infra red spectrum in which the carboxylate vibration was shifted to 1725 $cm^{-1}$ and a new vibration at 1220 $cm^{-1}$ also appeared both of which are characteristic of keto acids. It is believed therefore that a water soluble intermediate is the sodium salt of a keto acid.

A compound of identical infra red spectrum was obtained by warming glucose with sodium bicarbonate on a water bath. It would appear therefore that hydrolysis of the cellulose to glucose occurs as a primary step in the reaction.

The amounts of water soluble intermediate isolated are shown in Table 1.

The infra red spectra of samples of oil similarly deposited on a rock salt window were also examined. The spectra of all samples of oil showed prominent bands at 3450 $cm^{-1}$ (hydroxyl), 2950 $cm^{-1}$ (aliphatic C—H stretching), 1700 $cm^{-1}$ (acidic C=O and 1600 $cm^{-1}$ (ketonic C=O). A large number of strong but weakly-separated bands were observed between 1500 and 1000 $cm^{-1}$. This is in agreement with descriptions of oil structure.

Finally the infra red spectra of samples of residue incorporated in "Nujol" (Trademark) mulls were examined.

The residue showed a typical cellulose infra red spectrum with absorbtions at 3450, 2900, 1640, 1430, 1350 and 1060 $cm^{-1}$.

We claim:

1. A method for producing fuel oil from cellulosic material which comprises contacting the cellulosic material with liquid water and treating contacted material with a reducing gas which contains carbon monoxide in the presence of a catalyst comprising at least one metal, alloy of a metal and/or compound of a metal wherein the metal is selected from the group consisting of ruthenium, rhodium, palladium, osmium, iridium, platinum and copper and at an initial temperature of from 100° C. to 950° C. and an initial pressure of from 10 to 680 atmospheres.

2. A method according to claim 1 wherein the catalyst is precipitated in finely divided form onto the cellulosic material.

3. A method according to claim 1 or claim 2 wherein the liquid water is alkaline.

4. A method according to claim 1 wherein the partial pressure of carbon monoxide is maintained higher than the partial pressure of carbon dioxide.

5. A method according to claim 1 wherein the reducing gas is selected from the group consisting of hydrogen, methane, natural gas, water gas, producer gas and synthesis gas.

6. A method according to claim 1 wherein carbon monoxide is supplied to a vessel in which the method is performed.

7. A method according to claim 1 wherein the method is performed at a pressure of from 10 to 100 atmospheres.

8. A method according to claim 1 wherein the method is performed at a temperature of from 100° to 250° C.

9. A method according to claim 1 wherein the catalyst is selected from the group consisting of ruthenium metal, ruthenium alloy and ruthenium compounds.

10. A method according to claim 1 wherein an inert gas is supplied to the vessel in which the method is performed.

11. A method according to claim 2 wherein a residue remaining after performance of the method is recovered thereby facilitating recovery of the catalyst.

12. A method for producing fuel oil from a cellulosic material which comprises the steps of, (a) hydrolysing the cellulosic material to produce a hydrolysed material, (b) treating the hydrolysed material with carbon monoxide to produce a water soluble keto acid, (c) decarboxylating the keto acid to form an aldehyde in the presence of a catalyst comprising at least one metal, alloy of a metal or compound of a metal selected from the group consisting of ruthenium, rhodium, palladium, osmium, iridium, platinum and copper at a temperature of from 100° to 950° C. and a pressure of from 10 to 680 atmospheres and in the presence of a reducing gas whereby carbon dioxide produced by the decarbonylation is converted to carbon monoxide and water (including steam) and the aldehyde polymerises and (d) hydrogenating the polymerised aldehyde by means of the catalyst and reducing gas whereby the fuel oil is produced.

13. A method for producing fuel oil from cellulosic material which comprises contacting the cellulosic material with water and treating the contacted material with a reducing gas and carbon monoxide in the presence of a catalyst comprising at least one metal, alloy of a metal and/or compound of a metal wherein the metal is selected from the group consisting of ruthenium, rhodium, palladium, osmium, iridium, platinum and copper under conditions of temperature and pressure such that at least some of the water is liquid and at a temperature of at least 100° C. and a pressure of at least 10 atmospheres.

14. A method for disposing of cellulosic waste wherein the waste is converted to fuel oil by using it as the cellulosic material in the performance of a method as claimed in claim 1.

* * * * *